US005918859A

United States Patent [19]

Qian

[11] Patent Number: 5,918,859

[45] Date of Patent: Jul. 6, 1999

[54] STAPLE REMOVER

[76] Inventor: Shiguang Qian, 1944 Red Coach Rd., Allison Park, Pa. 15101

[21] Appl. No.: 08/787,256

[22] Filed: Jan. 24, 1997

Related U.S. Application Data

[63] Continuation-in-part of application No. 08/297,106, Aug. 26, 1994, abandoned.

[51] Int. Cl.[6] ..... B25C 11/00

[52] U.S. Cl. ..... 254/28

[58] Field of Search ..... 254/28, 18, 23

[56] References Cited

U.S. PATENT DOCUMENTS

| | | | |
|---|---|---|---|
| 2,400,988 | 5/1946 | Goessel | 254/28 |
| 2,662,727 | 12/1953 | Yerkes | 254/28 |
| 2,733,893 | 2/1956 | Segal | 254/28 |
| 3,345,036 | 10/1967 | Cooke | 254/28 |
| 3,484,080 | 12/1969 | Tolliver | 254/28 |

*Primary Examiner*—Robert C. Watson

[57] ABSTRACT

A staple remover having pair of slots in the claws of the jaws for complete removal of a staple with one action, avoiding one leg of the staple remaining in the object while the other leg being dislodged. The present device is as simple as the conventional staple remover in construction and manufacture, but the performance is significantly improved.

2 Claims, 5 Drawing Sheets

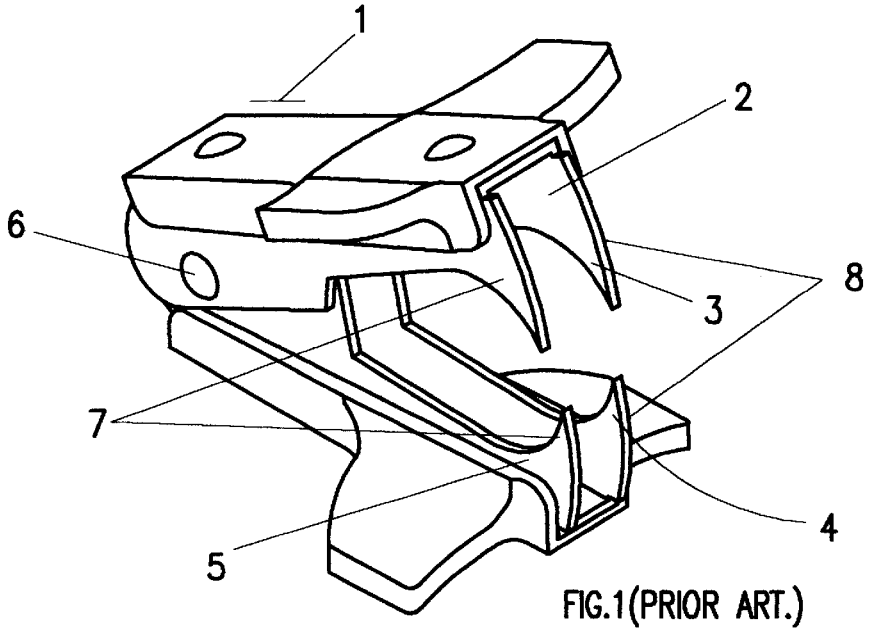
FIG.1(PRIOR ART.)
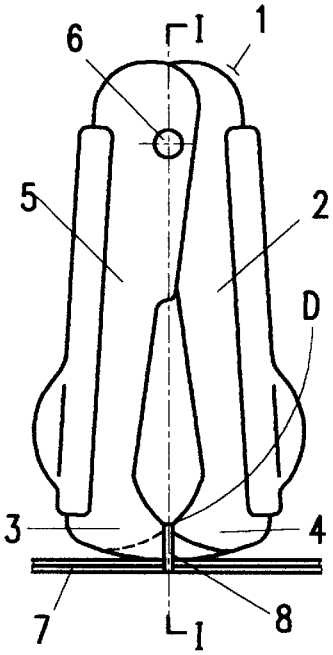
FIG.2(PRIOR ART.)
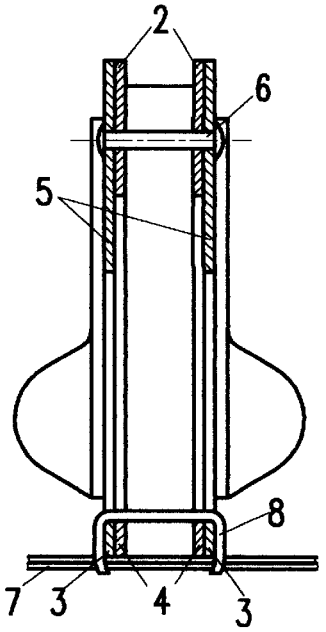
FIG.3(PRIOR ART.)
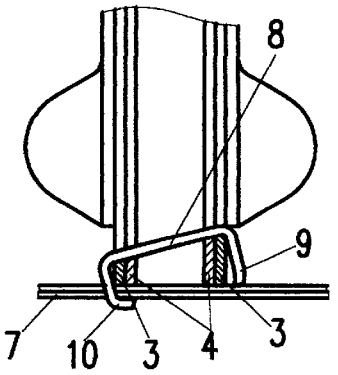
FIG.4(PRIOR ART.)

STAPLE REMOVER

This application is a continuation-in-part of application Ser. No. 08/297,106 filed on Aug. 26, 1994 now abandoned.

BACKGROUND OF THE INVENTION

1. Field of the Invention

The present invention relates to staple removers and more particularly, to improved staple removers which are capable of completely removing the staples from the object with one action and avoiding dislodging only one leg of the staple, leaving the other leg in the object.

2. Description of Prior Art

The conventional staple remover, as shown in FIG. 1, consists of right jaw 2 and left jaw 5. The ends of the jaws are pivotally mounted 6, with a spring inside (not shown in FIG. 1) keeping the jaw members open. The right and left jaws 2 and 5 are closed when they are pressed by fingers. The right and left jaws 2 and 5 have paired terminal claws 3 and 4 comprising pointed ends and inside curved edges 7 and outside flat curved edges 8. When dislodging a staple, the pointed ends of the claws insert between the staple and the object to which it was applied. The staple is thus forced open and removed from the object as shown in FIG. 3.

The disadvantage of the conventional staple remover 1 is, as shown in FIG. 4, that, not infrequently, one leg of the staple 9 is dislodged, while the other leg 10 remains in the object 7. When this occurs, the usual procedure employed is to grasp the staple with the fingers and to pull it free from the object.

A number of devices have been proposed for attempting to overcome this disadvantage. U.S. Pat. Nos. 3,311,346, 4,776,567, 5,085,404 and 5,292,106 are illustrative of such devices. However, they are all designed to add clamping members on the conventional staple remover, so that if one leg of the staple remains in the object, the protruding end of the staple may be removed by such clamping members. Adding the clamping members inevitably complicates its construction and certainly increases manufacture costs. In addition, the users usually need to take more actions and efforts to remove out the remaining portion of the staple with the clamping members.

In this respect, the present invention of the staple removers substantially departs from the concepts and designs of the prior art, provides staple removers primarily developed for the purpose of easily and completely removing the staples with no extra actions or efforts, without worrying of one leg of staples remaining in the object.

A further object of the present invention is to provide the staple removers with simple construction and low manufacture costs as the conventional staple removers, but with improved performances.

SUMMARY OF THE INVENTION

The present invention provides the improved staple removers. As such, the general purpose of the present invention is to provide the new and improved staple removers and methods which have all the advantages of the prior art and none of the disadvantages. The present invention consists of staple removers for removing staples secured to a plurality of sheets of paper or other materials which has been modified to overcome the disadvantages of the conventional staple remover that one leg of the staple may remain in the object while the free leg of the staple slips out of the grasp of the conventional staple remover.

Before explaining embodiments of the invention in detail, it is to be understood that the invention is not limited in its application to the detail of construction and to the arrangements of the parts set forth in the following description or illustrated in the drawings, and that the phraseology and terminology employed herein are for the purpose of description and should not be regarded as limiting.

The present invention is based on understanding the mechanisms of incomplete removal of the staples using the conventional staple remover. In the staple removing action of the conventional staple remover, the legs of the staple are forced open by closure of claws of the jaws of the staple remover. However, the resistances to opening the two legs of staple are often not equal. One leg of the staple is usually dislodged first, which results in the sudden reduction of the resistance, and then a sudden elevation of the dislodged leg of the staple, which limits the function of the claws to further release the other leg of the staple that is still lodged with the object. Therefore, preventing over-elevation of dislodged side of the staple may help to remove the other undislodged leg of the staple by the staple remover.

In one embodiment of the present invention, a staple remover includes a pair of opposing jaws pivoted together at the ends, with a spring inside keeping said jaws open; a pair of claws with pointed ends formed the free ends of each said jaw; each said claw formed by an outside and inside curved edges; a pair of slots on said claws of one of said jaws with their opening on the inside edges; the distance between said slot to said outside curved edge is equal or approximately equal to the length of the leg of staple; said slot is about parallel to said outside curved edge of said claw. If one leg of the staple is first dislodged, this side of the staple is elevated and enters said slots, which prevents it from further elevation and ensures the other leg of the staple effectively dislodged.

In a second embodiment, the pair of slots are provided in the claws of both jaws. Both pairs of the slots are aligned as the jaw members are closed. The dislodged staples may enter either pair of the slots.

In a third embodiment, the upper lips of the slots in the claws protrude towards inside. The protruding upper lips of the slots may ensure the staple entering the slots.

In another embodiment, the pair of slots in the claws are extended towards the outside of the device with an increasing curve in longitudinal dimension. The extension part of the slots may be used to collect the removed staples.

The invention is capable of other embodiments and of being practiced and carried out in various ways.

It is an object of the invention to provide improved staple removers that are capable of preventing one side of the staple from over-elevation and ensuring the effective dislodge of the other leg of the staple.

It is also an object of the invention to provide staple removers for removing the whole staple without extra steps and efforts.

It is also an object of the invention to provide the more effective staple removers not increasing the manufacture costs.

It is also an object of the invention to provide the staple removers that are inexpensive and simple to manufacture.

These and other objects of the invention will be more fully understood from the following description of the invention in reference to the illustrations appended hereto.

BRIEF DESCRIPTION OF THE DRAWINGS

FIG. 1 is a perspective view of the conventional staple remover.

FIG. 2 is a side elevational view of the staple remover shown in FIG. 1 with the jaws in the closed position to dislodge a staple.

FIG. 3 is a cross sectional view taken along the line I—I of FIG. 2, showing the staple being dislodged.

FIG. 4 is a cross sectional view taken from the line I—I of FIG. 2, showing one leg of the staple being dislodged, and the other leg remaining in the object.

DESCRIPTION OF THE PREFERRED EMBODIMENTS

With reference to the drawings the present invention is given to the following detailed description. As such, those skilled in the art will appreciate that the conception, upon which this disclosure is based, may readily be utilized as a basis for the designing of other structures, methods and systems for carrying out the several purposes of the present invention. It is essential, therefore, that the claims be regarded as including such equivalent constructions insofar as they do not depart from the spirit and scope of the present invention.

FIG. 1, generally at 1 is a conventional staple remover which includes a pair of opposing jaws 2 and 5 that are hinged at a pivot 6 near the rearward end portions. The jaws 2 and 5, having a pair of claws 3 and 4 with a pointed end respectively, remain open with a spring inside (not shown in FIG. 1).

Figure 5:
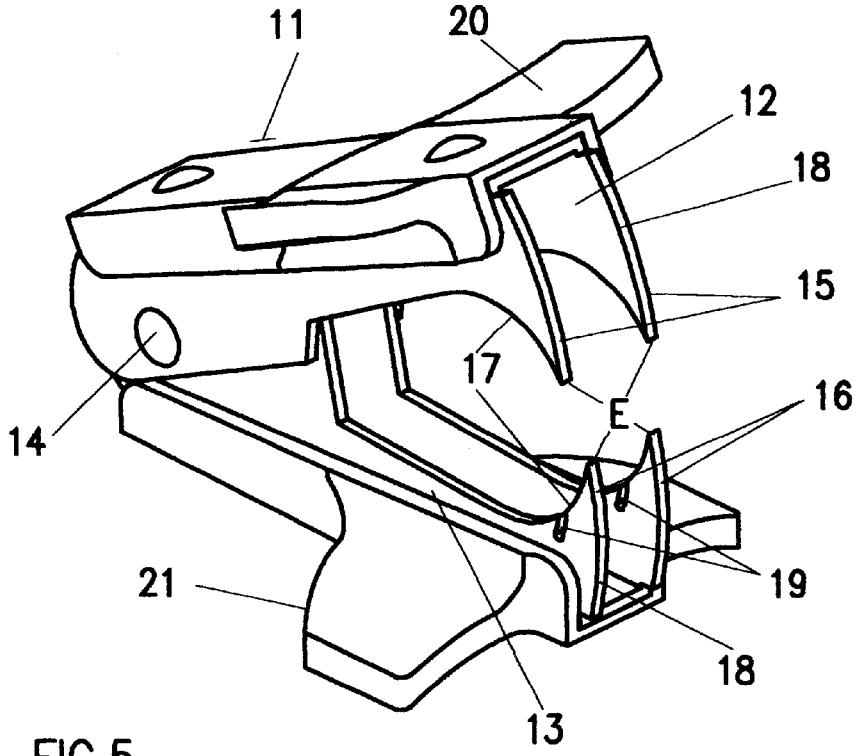
FIG. 5 is a perspective view of one embodiment of the present invention.

FIG. 2 and FIG. 3 illustrate a staple 8 that is dislodged by a conventional staple remover showing that the pointed ends of the claws 3 and 4 insert between the staple 8 and the object 7. As the jaws 2 and 5 are closed by the pressure of fingers, the point of intersection D of the inside curve profiles of claws 3 and 5 elevates resulting in the removal of the staple 8 from object 7. However, as illustrated in FIG. 4, because the usually unequally attached strength of the staple left and right legs 10 and 9 to the object 7, one leg 9 of the staple 8 loses its attachment to the object first as the staple 8 is attempted to be removed. Consequently, the dislodged leg 9 of the staple 8 is suddenly elevated resulting in dysfunction of dislodging the other leg of the staple 10. Illustrated in FIG. 5 and FIG. 6, generally at 11 is a staple remover that is one of the preferred embodiments of the present invention. The staple remover 11 is a modified conventional staple remover, as are all of the embodiments that will be described herein. The staple remover 11 includes a pair of opposing jaws 12 and 13. The rearward ends of the jaws 12 and 13 are hinged at pivot 14 with a spring inside (not shown in the FIGS.) urging the jaws 12 and 13 to the open position. The jaws 12 and 13 may be closed by an outside pressure. Each of the jaws 12 and 13 attaches a finger hold plate 20 and 21, respectively. Each of the jaws 12 and 13 includes a pair of spaced apart, parallel claws 15 and 16 that extend longitudinally on the other side of the jaws 12 and 13. The spacing of the claws 15 relative to the spacing of the claws 16 is such that the claws 16 are inside and closely adjacent to the claws 15 to permit relative pivotal movement of the claws 16 between the open and closed positions.

Figure 7:
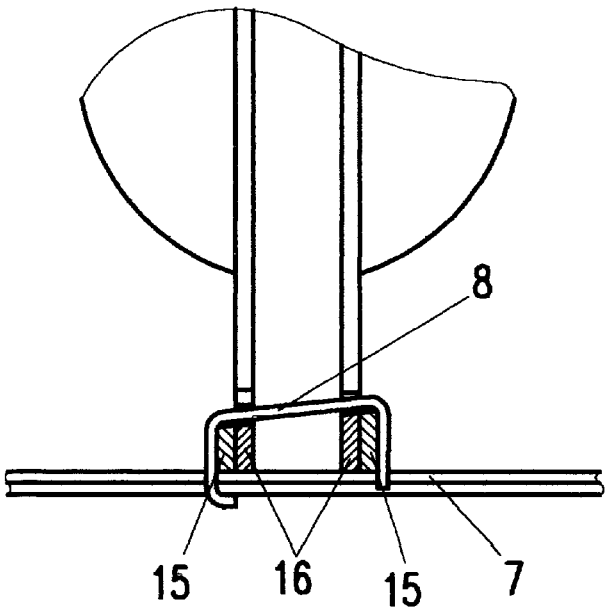
FIG. 7 is a cross sectional view taken along the line II—II of FIG. 6.
Figure 6:
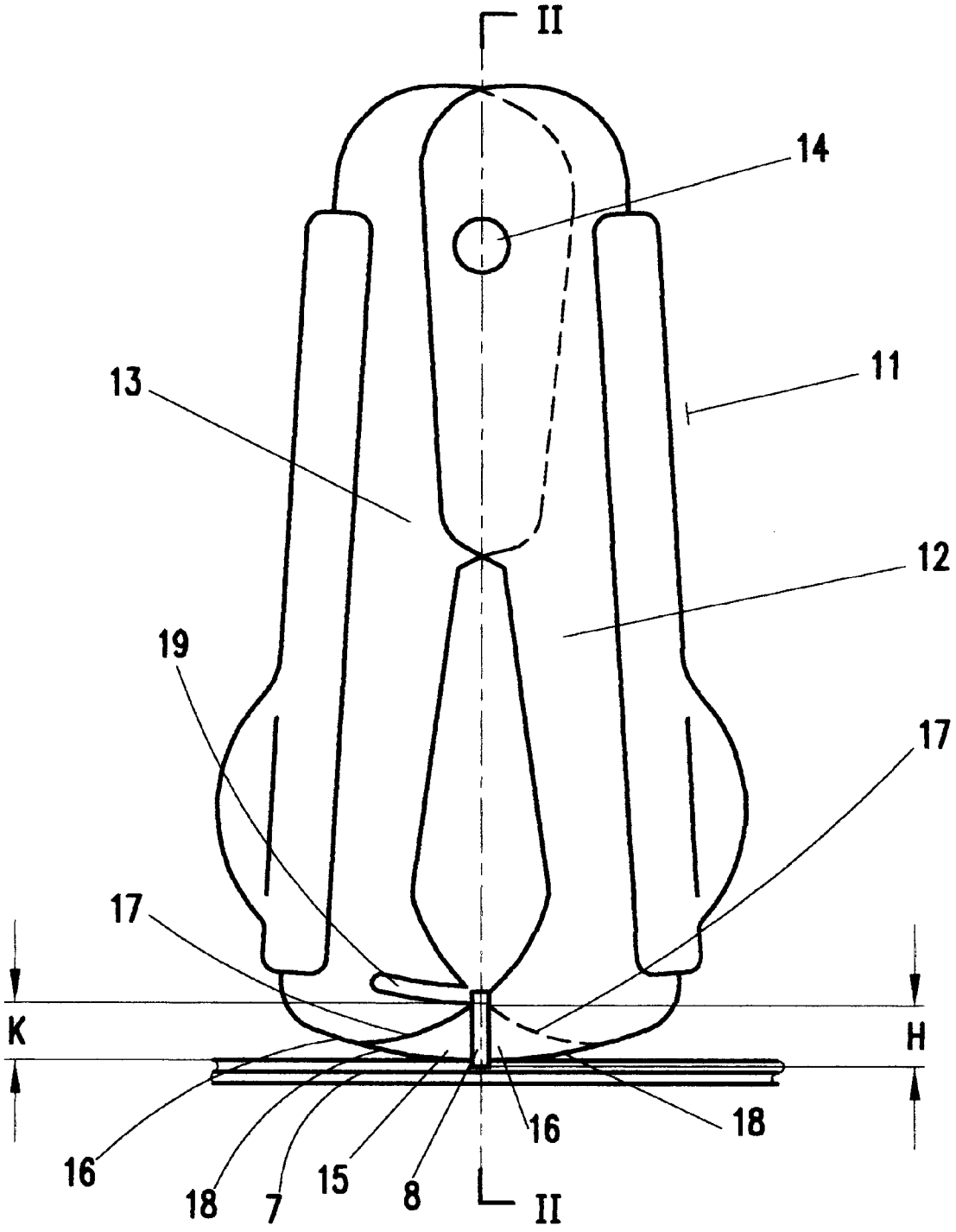
FIG. 6 is a side elevational view of the staple remover of the present invention dislodging a staple.
Figure 10:
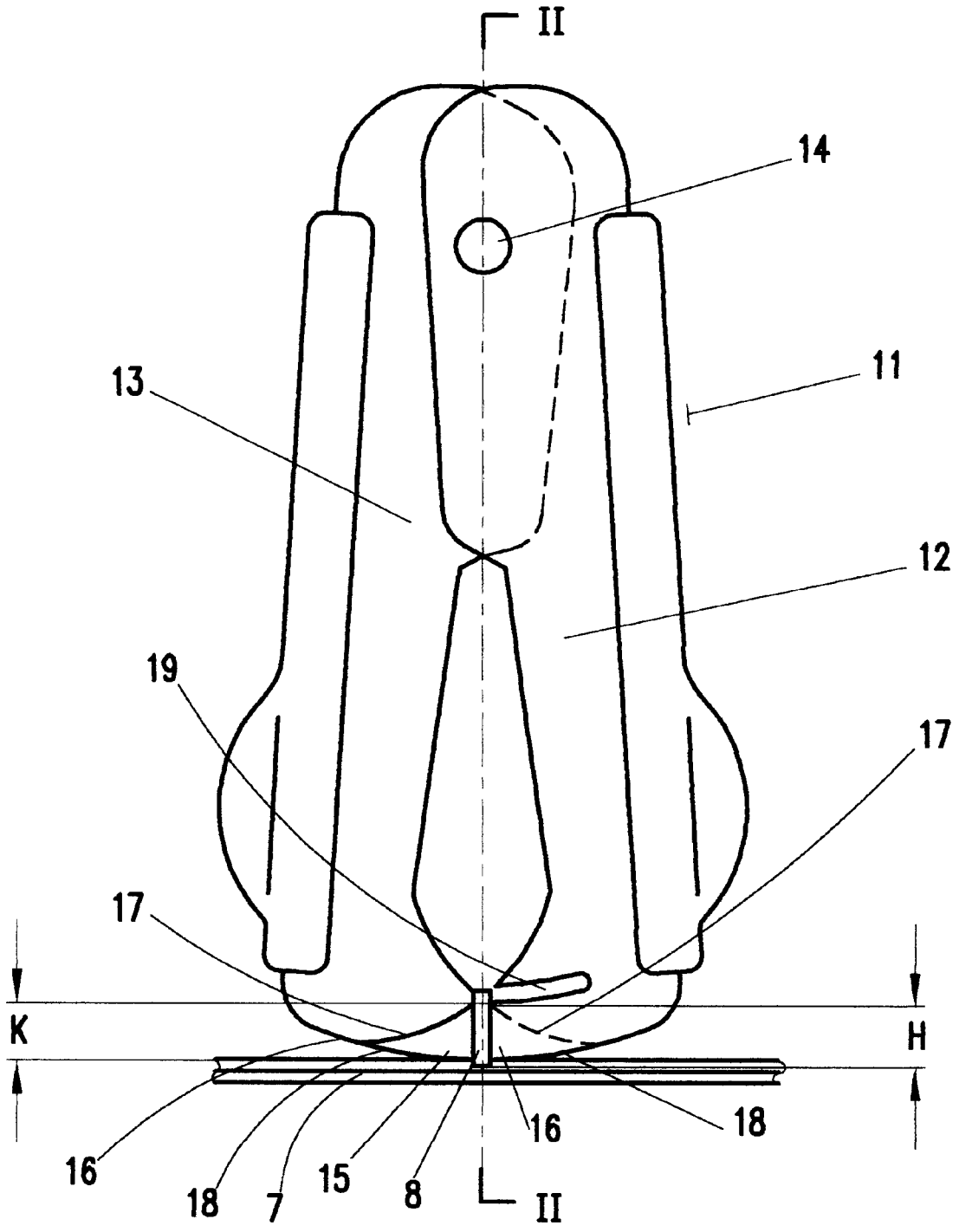
FIG. 10 is a side elevational view of alternative embodiment of the present invention.

The claws 15 and 16 have outside edges 18 that are slightly curved outwardly or in arcs related to the hinge pivot 14 for insertion beneath the staple to be removed from a plurality of papers or other material. The inside edges 17 curve outwardly and rearwardly from the point E to a substantially straight section and then to overlap section near the hinge 14. A pair of slots 19, that are wide enough to contain the wire of the staple 8, are provided on the pair of claws 16 of the left jaw 13. The two slots 19 are about parallel to the outside edges 18 of the claws 16 of the left jaw 13 and open to the inside edges 17. The two slots 19 are symmetrical. The distance K (FIG. 6) between the slots 19 to the outside edges 18 of the claws 16 are equal or approximately the length of the leg of the staple H (FIG. 6). The operation of the staple remover 11 is illustrated in FIG. 6 and FIG. 7. The staple remover 11 is pressed together with the claws 15 and 16 engaging between the staple 8 and the object 7. The concave inside edges 17 cam the staple upwards and the staple is removed from the object. In case that one leg of the staple is dislodged first, then this side of the staple slips into the slot 19 of the engaged claw 16, which prevents this side of staple further elevation, and ensures the other leg of the staple 8 effectively dislodged. One alternative is that the same pair of the slots 19 described above may be provided in the right jaw 12 instead of in the left jaw 13 (shown in FIG. 10.). Another alternative is that both jaws 12 and 13 may have the same pairs of slots. Both pairs of the slots are aligned as the jaw members are closed (not shown in FIGS.).

Figure 8:
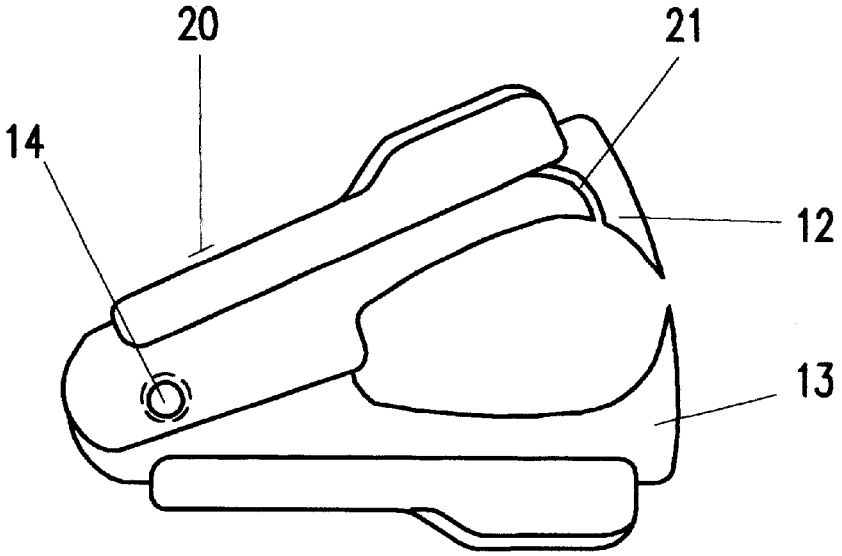
FIG. 8 is a side elevational of another embodiment of the present invention.

A second embodiment of the present invention of the staple remover is indicated generally at 20 is FIG. 8. The device 20 is identical in structure and functions to the device 11 described in the preceding sections except that the slots 21 on the jaw 12 are extended, and the extended portions of the slots curve outwardly and rearwardly to the 5 hinge pivot 14, which can be utilized to collect the removed staples. As an alternative embodiment, such slots 21 can be provided on right jaw 13 instead of left jaw 12, or provided on both jaws 12 and 13.

Figure 9:
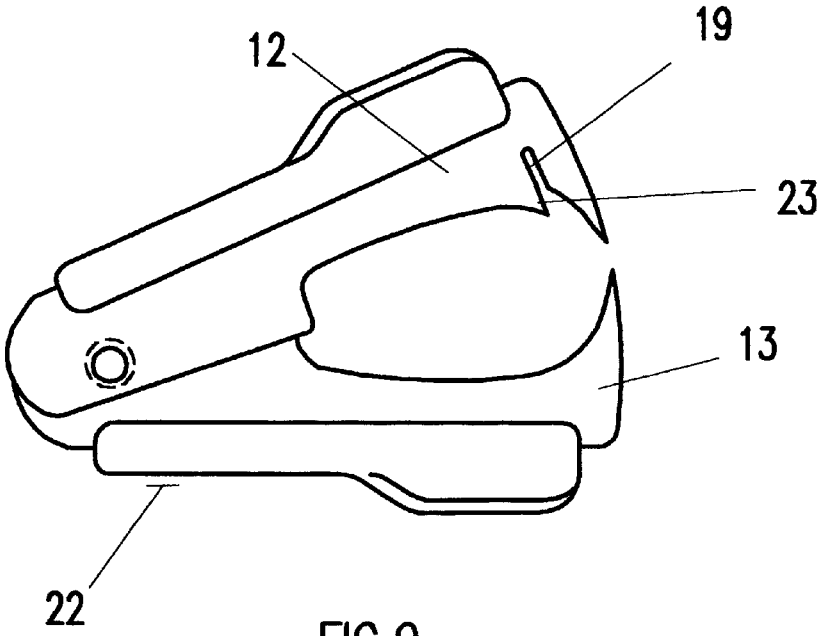
FIG. 9 is a side elevational view of yet another embodiment of the present invention.

In a third preferred embodiment, a staple remover is illustrated generally at 22 in FIG. 9. The device 22 is identical in structure and functions to the device 11 described in the preceding sections except that the upper edges of the slots 19 have protruding lips 23 that may ensure the dislodged side of the staple slips into the slots 19. As alternative 20 embodiments, such slots 21 can be provided on left jaw 13 instead of right jaw 12, or provided on both jaws 12 and 13. As another alternative, the slots of device 22 are curvedly extended as described in device 20.

I claim:

1. A staple remover comprising:

a pair of jaws pivoted together at ends of said jaws with a spring keeping them open;

a pair of claws with pointed ends formed on other ends of each of said pair of opposed jaws, said claws formed by an outside and inside curve edges;

a pair of slots formed on one jaw with a slot formed on each claw of said pair of claws with slot openings on said inside edges, the distance between said slot and said outside curved edges being equal or approximately equal to the length of the leg of a staple, said slot being about parallel to said outside curve edge of said claw.

2. The staple remover of claim 1, wherein the two slots of said pair of slots are symmetrical.

* * * * *